US007677150B2

(12) United States Patent
Dater et al.

(10) Patent No.: US 7,677,150 B2
(45) Date of Patent: Mar. 16, 2010

(54) MOUNTING SYSTEM FOR MUZZLE DEVICES AND FIREARMS

(75) Inventors: Philip H. Dater, Boise, ID (US); Thomas T. Hoel, Arvada, CO (US)

(73) Assignee: Gemini Technologies, Inc., Boise, ID (US)

( * ) Notice: Subject to any disclaimer, the term of this patent is extended or adjusted under 35 U.S.C. 154(b) by 754 days.

(21) Appl. No.: 11/546,718

(22) Filed: Oct. 11, 2006

(65) Prior Publication Data

US 2007/0095198 A1 May 3, 2007

Related U.S. Application Data

(60) Provisional application No. 60/731,002, filed on Oct. 28, 2005.

(51) Int. Cl.
*F41A 21/48* (2006.01)

(52) U.S. Cl. ..... 89/14.05; 89/14.2; 89/14.3; 89/14.4

(58) Field of Classification Search ..... 89/14.05, 89/14.1–14.5; 403/166, 325, 324, 357, 359.5, 403/378, 381, 354; 267/291
See application file for complete search history.

(56) References Cited

U.S. PATENT DOCUMENTS

| | | | | | |
|---|---|---|---|---|---|
| 221,153 | A | | 11/1879 | Chapin | |
| 1,138,465 | A | * | 5/1915 | Fegley et al. | 403/325 |
| 2,139,519 | A | * | 12/1938 | Schmitt | 403/166 |
| 2,232,997 | A | * | 2/1941 | Caldwell | 403/146 |
| 3,280,439 | A | * | 10/1966 | Mccarthy | 403/325 |
| 3,345,711 | A | * | 10/1967 | Mccarthy | 403/166 |
| 3,637,240 | A | | 1/1972 | Meier | |
| 3,687,000 | A | * | 8/1972 | Csizmar et al. | 89/14.5 |
| 3,744,370 | A | * | 7/1973 | Snodgrass | 89/14.5 |
| 3,766,822 | A | | 10/1973 | Sophinos | |
| 3,913,954 | A | | 10/1975 | Klimpl | |
| 3,971,285 | A | * | 7/1976 | Ellis et al. | 89/14.3 |
| 4,105,347 | A | * | 8/1978 | Gossage | 403/325 |

(Continued)

FOREIGN PATENT DOCUMENTS

GB 2242476 10/1991

OTHER PUBLICATIONS

Product Brochure: Rotex-III Rifle Supressors, Brugger & Thonet AG.

*Primary Examiner*—Michael Carone
*Assistant Examiner*—Jonathan C Weber
(74) *Attorney, Agent, or Firm*—Bermet K. Langlotz; Langlotz Patent & Trademark Works, Inc.

(57) ABSTRACT

A system for connecting an accessory to a firearm having an enlarged muzzle portion has a body with a bore sized to closely receive the enlarged portion. The body has a stop to limit the insertion depth of the muzzle. A gate is received by the body for movement along the path perpendicular to the bore axis. The gate has a recessed area sized to receive the enlarged muzzle portion. A spring generates axial force to retain the muzzle portion within the recessed area. Compression of the spring enables movement of the gate to shift between an open and closed position, so that the accessory may be removed or installed when in the open position, and secured when in the closed position.

18 Claims, 5 Drawing Sheets

U.S. PATENT DOCUMENTS 4,389,135 A * 6/1983 Peters ..... 403/327
4,813,333 A * 3/1989 Garris et al. ..... 89/14.3
4,893,426 A * 1/1990 Bixler ..... 42/75.01
4,929,113 A * 5/1990 Sheu ..... 403/325
4,943,182 A * 7/1990 Hoblingre ..... 403/325
5,056,764 A * 10/1991 Mochizuki ..... 403/324
5,060,894 A * 10/1991 Hillinger ..... 403/166
5,312,125 A * 5/1994 Tsao ..... 403/325
5,377,438 A * 1/1995 Sheinfeld et al. ..... 89/14.5
5,433,133 A * 7/1995 La France ..... 89/14.2
5,464,300 A * 11/1995 Crainich ..... 403/325
5,559,302 A 9/1996 Latke
5,685,102 A * 11/1997 Latka ..... 89/14.05
5,773,746 A * 6/1998 Vaden ..... 89/14.4
6,019,014 A * 2/2000 Jenkins ..... 403/325
6,026,728 A 2/2000 Guhring et al.
6,176,032 B1 * 1/2001 Cohen et al. ..... 89/14.5
6,289,623 B1 * 9/2001 Cohen et al. ..... 89/14.5
6,412,389 B2 7/2002 Fluhr
6,619,179 B2 * 9/2003 Mika ..... 89/14.05
6,701,820 B2 3/2004 Fluhr
6,973,863 B1 * 12/2005 Jones ..... 89/14.2
7,448,823 B2 * 11/2008 Silva ..... 403/325
2001/0049996 A1 * 12/2001 Fluhr ..... 89/14.4
2003/0019351 A1 * 1/2003 Fluhr ..... 89/14.4
2003/0019352 A1 * 1/2003 Mika ..... 89/14.05
2008/0098880 A1 * 5/2008 Brugger ..... 89/14.4

* cited by examiner

MOUNTING SYSTEM FOR MUZZLE DEVICES AND FIREARMS

REFERENCE TO RELATED APPLICATION

This non-provisional patent application is related to provisional application for patent application No. 60/731,002 filed Oct. 28, 2005.

FIELD OF THE INVENTION

The present invention relates to firearms, and more particularly to facilities for mounting on the muzzle a device, such as a sound suppressor, muzzle brake, recoil compensator or blank firing adapter.

BACKGROUND AND SUMMARY OF THE INVENTION

Is often desirable to mount removable devices at the muzzle of a firearm. A sound suppressor or silencer reduces the sound of the discharge of a firearm; a muzzle brake or compensator reduces recoil forces; a blank firing adapter is useful for training and for launching of grenades and rescue devices.

A conventional muzzle mounted accessory may be internally threaded to engage a threaded and of a firearm barrel. This has the disadvantage of being slow to mount and dismount, a serious concern in military and law enforcement contexts. Other prior art mounts provide quicker disconnection, but suffer other disadvantages such as inadequate repeatable precision of alignment (which generates shooting inaccuracy), complexity and cost of manufacture, and durability. Other prior art systems require modification of the firearm, and proprietary adapter components.

A number of patents have been granted for mounting muzzle devices, such as sound suppressors, to firearms. Various approaches also exist in the practiced prior art. However, there are a number of problems with prior art patents and existing practiced prior art. These problems include unwanted modifications to the barrel, the undesirable requirement of a proprietary flash hider, and the associated costs and time due to the installation of a proprietary flash hider. One of the major problems is that existing systems require modifications to the host firearm. These modifications either mean the machining of the existing barrel to accommodate the mounting system, or the installation of proprietary flash hiders that allow for the attachment of muzzle devices such as sound suppressors.

To minimize these problems, there have been a number of different approaches that have been used in past years. One approach has been to specially design the host firearm to allow for attachment of a sound suppressor. This adds an unwanted burden at the stage of designing the firearm, and requires that the firearm manufacturer be cognizant of a possible requirement to attach a sound suppressor to the firearm as part of the design criteria.

Another approach has been to design the mounting system to allow mounting to the existing flash hider on the standard rifle, and U.S. Pat. No. 5,773,746 (Vaden) is an example of this approach. This patent discloses a mounting system that allows for the quick attachment and detachment of a sound suppressor to the M4/M16A2 series of rifles that are equipped with a standard flash hider or compensator. The Vaden patent features the use of 3 pivoting fingers that are moved into position and locked onto the rear of the flash hider via the use of a rotating collar. A combination of left and right hand threads in the rotating collar and body of the mount meant that the collar was simply and quickly rotated one way to lock and the other way to unlock the sound suppressor from the flash hider.

G.B. Patent 2,242,476 (Felton) discloses a mounting system that allows a sound suppressor or muzzle device to be fitted to a wider variety of military rifles, which may be fitted with different length flash hiders that are conventionally threaded for attachment to a threaded muzzle. However, the design utilized a U-shaped cutout in a locking collar to accommodate the various flash hiders, and this collar was then secured to the rear of the flash hider by tightening up the suppressor (and subsequently the collar to the sound suppressor) against the front end of the flash hider. Screwing down the suppressor generates compression of the flash hider.

Another approach used by Knight Armament Company and Brugger & Thonet, AG, is the use of a U-shaped locking gate that fits onto a proprietary flash hider and which is held under spring tension to the flash hider via an enlarged BFA (Blank Firing Adapter) groove that is machined into the exterior of the flash hider near the rear end of the flash hider. To ensure that the suppressor did not detach due to spring failure, a secondary retention system was added to the mount to ensure that the suppressor stayed attached to the host rifle if spring failure occurred.

The approach of installing a proprietary attachment is also typified by U.S. Pat. No. 6,948,415 (Matthews et al) where the sound suppressor is attached and secured to a one-piece adapter and compensator that extended back over the barrel. The suppressor attached to an annular ridge on the adapter through the use of a rotating ring having an opening that is concentric when open and eccentric when closed, thus locking the sound suppressor to the adapter and compensator. This method of attachment is also in the existing practiced prior art as used by Brugger & Thomet (B&T) of Switzerland with the mounting system used with the Rotex-II 5.56 mm sound suppressor. Rather than being attached to an annular ridge on an adapter and compensator as per the Matthews patent, the mounting system of the Rotex-II was secured to a standard M4/M16A2 compensator and secured the sound suppressor against the rear of the standard M4/M16A2 compensator.

All of the above systems have significant disadvantages in terms of cost, reliability, durability, accuracy, and/or combinations of these.

It is therefore an object of this invention to provide a mounting system that provides a quick, secure and mechanically strong mounting system for muzzle devices such as sound suppressors, muzzle brakes, recoil compensators and BFAs (Blank Firing Adapters) to a firearm, that secures the muzzle device to the firearm regardless of vibrations from firing of the rifle, and allows for the quick and easy removal of the muzzle device from the firearm.

The present invention overcomes the limitations of the prior art by providing a system for connecting an accessory to a firearm having an enlarged muzzle portion has a body with a bore sized to closely receive the enlarged portion. The body has a stop to limit the insertion depth of the muzzle. A gate is received by the body for movement along the path perpendicular to the bore axis. The gate has a recessed area sized to receive the enlarged muzzle portion. A spring generates axial force to retain the muzzle portion within the recessed area. Compression of the spring enables movement of the gate to shift between an open and closed position, so that the accessory may be removed or installed when in the open position, and secured when in the closed position.

DETAILED DESCRIPTION OF A PREFERRED EMBODIMENT

Figure 1:
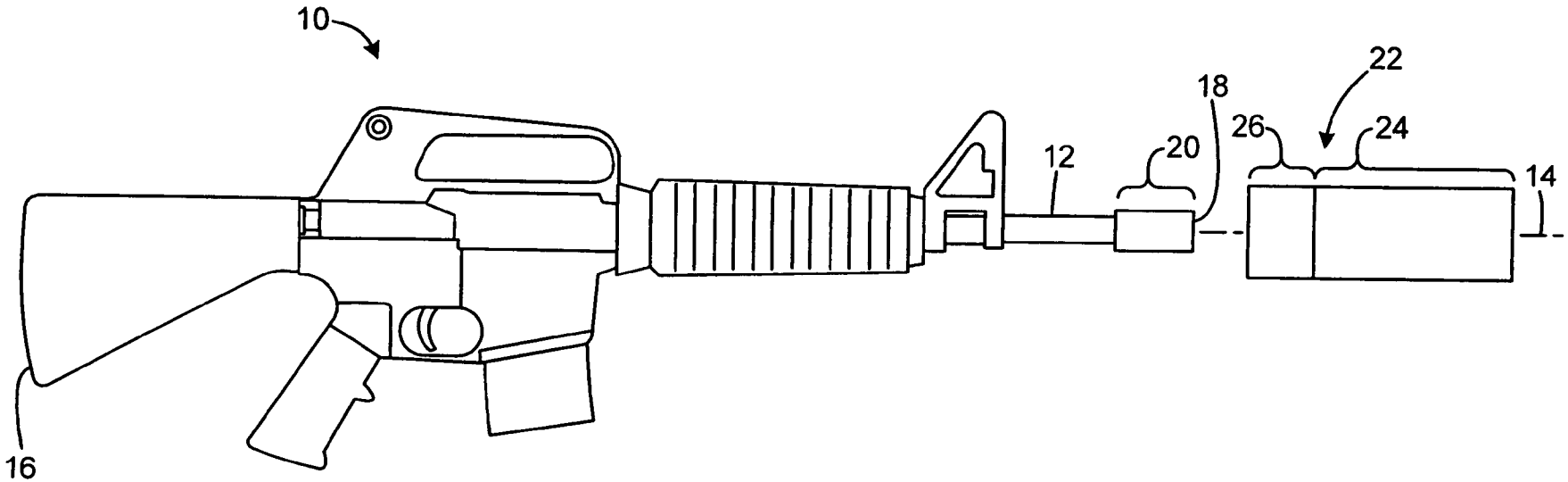
FIG. 1 is a side view of a preferred embodiment of the invention.

FIG. 1 shows a rifle 10 having a barrel 12 defining an axis 14. The rifle has a rear end 16, and the barrel has a forward muzzle end 18 having an enlarged end portion 20. The end portion 20 has a cylindrical shape with a diameter larger than that of the barrel 12. In one application for the preferred embodiment the barrel has an outside diameter of 0.735 inch just rearward of the end portion 20, and the enlarged portion 20 has a diameter of 0.860 inch, and a length of 1.75 inch. The end portion may be a permanently or temporarily mounted flash hider, muzzle brake, or other facility, or may be a dedicated integral or attached element specifically for receiving the attachment discussed below.

In the application illustrated in the preferred embodiment, a sound suppressor 22 is prepared for installation at the muzzle. The suppressor 22 has an elongated forward portion 24 having an expansion chamber and including baffles and other functional elements. A adapter or rear portion 26 of the suppressor is removably connected to the forward portion, and serves as a connection facility to provide a secure, reliable, repeatable and rigid connection between the suppressor and a rifle. In alternative embodiments, the forward portion 24 may be any functional firearms device such as a flash hider, muzzle brake, grenade launcher, blank firing adapter, or rescue device launcher.

Figure 2:
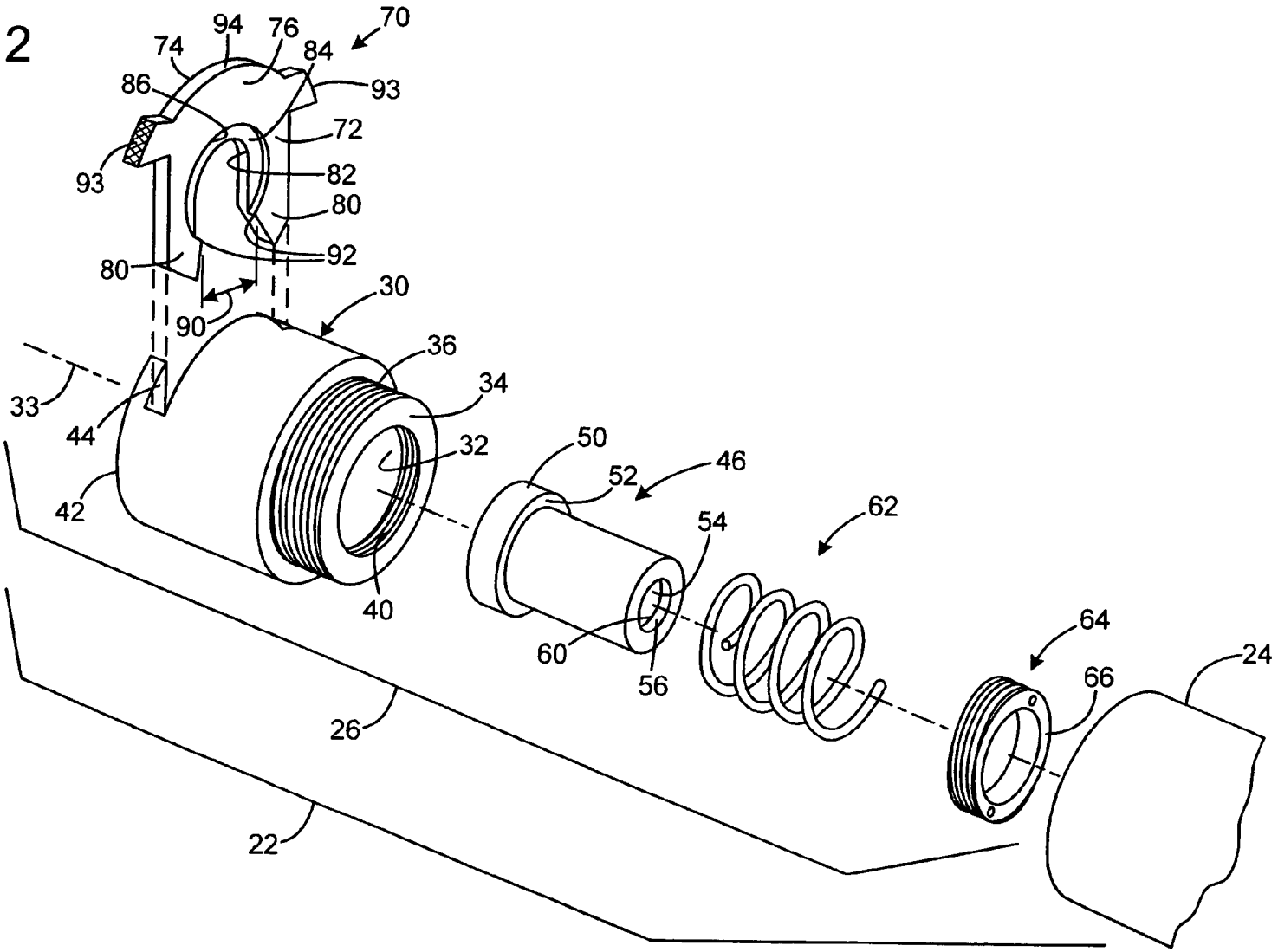
FIG. 2 is an exploded perspective view of the embodiment of FIG. 1.

FIG. 2 shows the suppressor 22, and the components of the adapter or connection portion 26. The chassis or main portion of the adapter is a body 30 that is a generally hollow cylindrical form defining a central bore 32 defining a central axis 33. The body has a forward rim 34 with an externally threaded portion 36 for engagement with the forward portion 24. The bore has an internally threaded portion 40 near the forward rim. At a rear end 42 of the body, a slot 44 is defined in a plane perpendicular to the axis 33. The slot is enclosed on the lower and side portions of the body, and open in the upward direction, as illustrated.

A sleeve element 46 is a generally cylindrical body having a flange portion 50 at a rear end, which defines a shoulder 52 that faces in a forward direction. The sleeve defines a cylindrical bore 54 having a reduced diameter stop portion 56 that defines an internal shoulder 60. The opening to the bore 54 at the rear end 50 is flared with a chamfer or radius, as will be illustrated further below. The flange portion 50 has an exterior diameter of

_____ inch, which closely fits within the body's bore 32.

A compression coil spring 62 has an internal diameter sized to be closely and slidably received by the main portion of the sleeve, and an external diameter slightly less than that of bore 32. In the preferred embodiment, the spring has a length greater than the space it will occupy, as will be discussed below, so that it can be preloaded with a force of

_____ pounds required to resist unwanted removal of the accessory.

A capture ring 64 is externally threaded to mate with the threads 40, and has an internal aperture 66 diameter sized to closely and slidably receive the forward end of sleeve 46.

A gate element 70 is a rigid planar body having a thickness sized to be closely received within slot 44 of the body 30. The gate has a forward face 72 and a parallel rear face 74. The gate has a generally U-shaped profile having a curved base 76 with a pair of spaced apart legs 80 extending downwardly. The gate defines a central accurate aperture 82 that is slightly larger in diameter than the exterior of the barrel 12 at the location just rear of the end portion 20. The aperture diameter is significantly smaller than the outside diameter of the end portion 20. The aperture 82 is open in a downward direction, with the narrowest portion or entry to the aperture being greater than the barrel diameter, so that the gate can be shifted over the barrel as will be discussed below.

The gate element defines a circular recess 84 that is concentric with aperture 82 and which provides a recess to a partial depth of the thickness of the gate. The recess 84 has a boundary 86 that is a major portion of a circle, and which extends more than 180° about its center. This ensures that a gap 90 formed by the two closest points 92 at the open end of the boundary has a width of less than the diameter of the end portion 20 of the muzzle. The recessed area 84 has a diameter sized to closely receive the rear end of muzzle portion 20. When so received, the gate and muzzle are laterally engaged to each other, because the muzzle end portion cannot pass through gap 90, being captured in the recess 84.

The gate further includes protruding ears 93 having knurled surfaces that provide a gripping point when the gate is fully installed in the body. When so installed, the curved upper periphery 94 of the gate is flush with the exterior surface of the body 30.

In the preferred embodiment the body, ring 64, and gate are formed of aluminum or other lightweight metal, and the sleeve 46 and gate 70 formed of steel or other hard and durable material that can provide repeated and close precision engagement with a steel muzzle element.

Figure 3A:
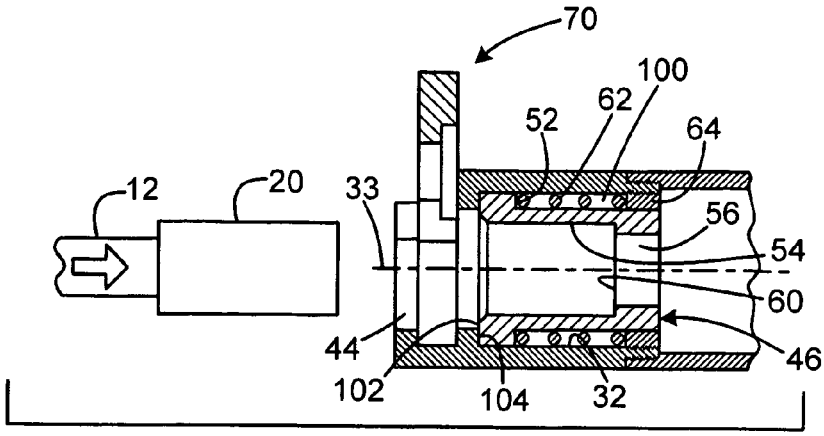
FIGS. 3A and 3B are a sectional side view and a simplified end view of the preferred embodiment in a first stage of installation.
Figure 3B:
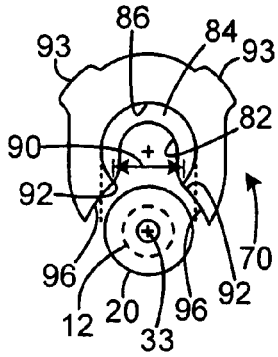

FIGS. 3A and 3B show the preferred embodiment in a condition in which it is prepared for installation. The gate 70 is in an open position in which it is fully extended away from the axis 33 in a lateral direction. A scalloped clearance portion 96 of the gate at the open end provides clearance for the muzzle element 20 to be inserted into the adapter.

The spring 62 is received in a cylindrical gap 100 between the sleeve 46 and the body 30, and is axially trapped between the shoulder 52 of the sleeve and the ring 64. In this condition, the rear face 102 is biased against a shoulder 104 at the rear of the body's bore 32.

Figure 4A:
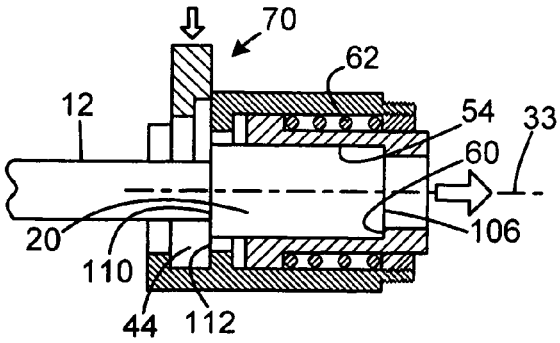
FIGS. 4A and 4B are a sectional side view and a simplified end view of the preferred embodiment in a second stage of installation.
Figure 4B:
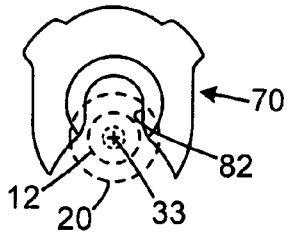

In FIGS. 4A and 4B, the muzzle element 20 has been fully inserted into the sleeve bore 54, so that a forward end 106 of the muzzle presses against shoulder 60. The muzzle is pressed with adequate axial force to compress the spring 62, so that the rear end 110 of the muzzle element 20 is forward of a forward face 112 of slot 44. This allows the gate 70 to be moved downward into the intermediate position shown in FIG. 4B, in which the aperture 82 is clearing barrel 12 as the gate is moved toward the closed position.

Figure 5A:
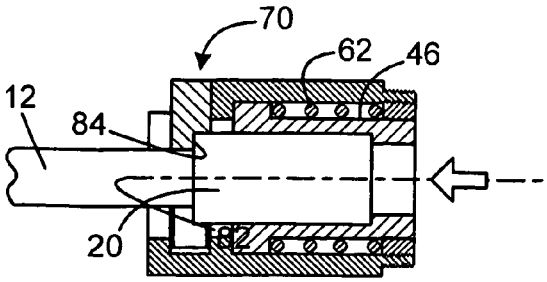
FIGS. 5A and 5B are a sectional side view and a simplified end view of the preferred embodiment in a third stage of installation.
Figure 5B:
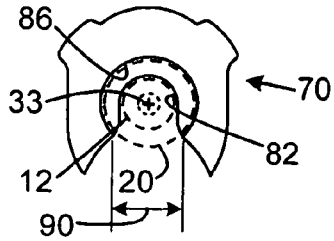

FIG. 5B shows the gate 70 in the fully closed position with the aperture 82 concentric with and closely receiving the barrel 12, and the recess boundary 86 concentric with and closely receiving the muzzle element 20. As shown in FIG. 5A, the axial force between the rifle and the attachment has been released, and the spring 62 has returned the sleeve 46 to its original position. As the sleeve is engaged to the muzzle, the spring has shifted the body forward with respect to the firearm. Thus, the spring has forced the rear end of the muzzle portion 20 into the recess 84. Because the gap 90 is less than the diameter of muzzle portion 20, the gate may not now be extracted from the closed position shown, and the attachment is locked in place, securely installed. When installed, the closeness of the fit between the muzzle portion 20 and the sleeve bore 54 ensures that the attachment is concentric with the rifle bore. The muzzle portion 20 remains under compressive force between the sleeve shoulder 60 and the gate recess 84. This provides a positive axial position of the device.

Removal or uninstallation of the suppressor from the rifle muzzle follows the reverse process. Deliberate axial force is applied between the suppressor and the rifle to compress the spring, moving the rear of the muzzle portion 20 forward and clear of the gate, so that it may be extracted to the open position, and the muzzle then withdrawn from the bore of the sleeve.

Alternative Embodiment

Figure 6:
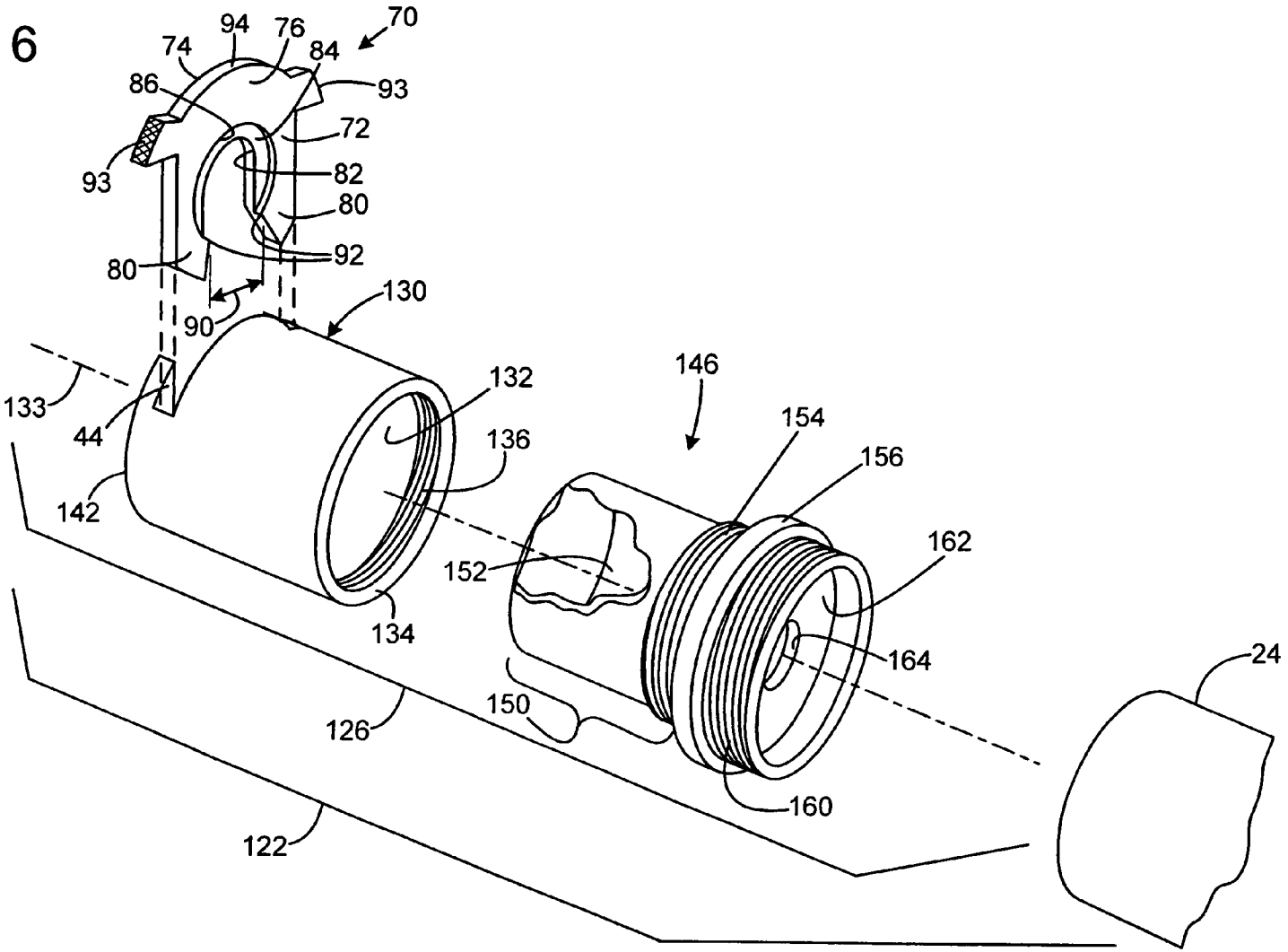
FIG. 6 is an exploded perspective view an alternative embodiment of the invention.

FIG. 6 shows an alternative suppressor 122, and the components of an adapter or connection portion 126. The chassis or main portion of the adapter is a body 130 that is a generally hollow cylindrical form defining a central bore 132 defining a central axis 133. The body has a forward rim 134 with an internally threaded portion 136. At a rear end 142 of the body, a slot 44 is detined in a plane perpendicular to the axis 33. The slot is enclosed on the lower and side portions of the body, and open in the upward direction, as illustrated.

A sleeve element 146 is a generally tubular body having a rear portion 150 defining a smooth cylindrical bore 152 that closely receives muzzle portion 20. The exterior of the rear portion 150 has a threaded forward portion 154 that mates with the threads 136 of the body 130. A flange 156 is forward of the threads 154 to provide a stop against the body rim 134. A threaded exterior forward portion 160 mates with internal threads of the forward portion 24 of the suppressor. In the interior of the sleeve, a stop 162 defines an aperture 164 and provides an internal shoulder against which will abut the forward end of the muzzle portion 20 residing in the bore 152. The gate element 70 is essentially the same as in the preferred embodiment.

Figure 7:
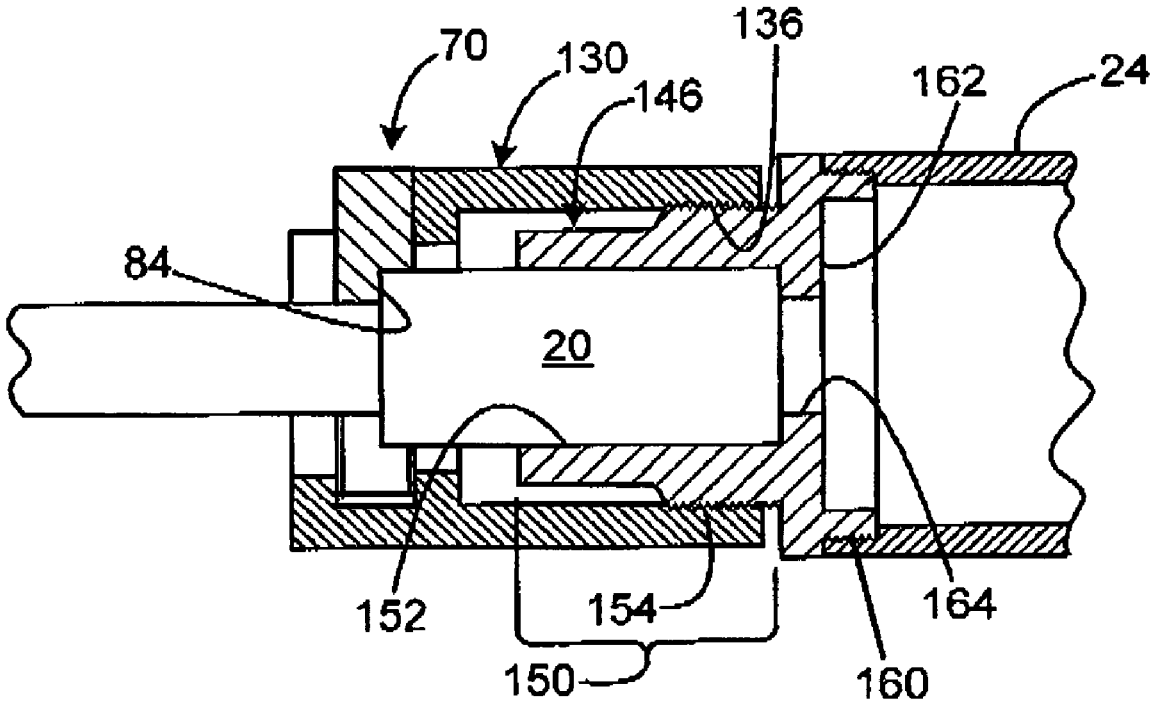
FIG. 7 is a sectional side view of the embodiment of FIG. 6 in an installed condition.

FIG. 7 shows how the alternative embodiment operates analogously to the preferred embodiment. The essential difference between the embodiments is in the mechanism that provides axial force on the forward end of the muzzle element 20. Both embodiments secure the device to the muzzle element 20 by compressing against the forward end of the muzzle element, and forcing the rear end of the muzzle element into the recess 84 of the gate 70, preventing the gate from being extracted. However, instead of using spring force to maintain the rear of the muzzle element in the recess, the alternative embodiment uses the helical threads 136 and 154 to screw the sleeve 146 rearwardly, positively and axially compressing the muzzle end portion 20.

To permit the gate to operate for installing and removing the suppressor from the muzzle, the muzzle must be permitted to move forward relative to the gate 70, so that the rear end of the muzzle element 20 can clear points 92. Instead of this being achieved by pressing together the muzzle and the can to compress the spring-biased sleeve as in the preferred embodiment, it is achieved in the alternative embodiment by unscrewing the sleeve 146 and forward portion 24 (which are tightly screwed together so as not to be disengaged during normal installation and removal operations). The forward portion need only be unscrewed enough to provide axial movement at least as great as the depth of the recess 84. In the preferred embodiment this is about one half turn. By requiring a significant rotation of this amount, even slight inadvertent loosening of the suppressor from the mount during operation will still not permit the gate to be opened. Another advantage of the alternative embodiment is that significant compressive force can be achieved by tightening down the threaded connection. This can provide added insurance against misalignment (because the forward and rear end faces of the muzzle portion 20 may be used as alignment surfaces), and can provide a force well in excess of any useful spring force employed in the preferred embodiment.

Additional Description

The preferred embodiment of the present invention is a mounting apparatus providing a quick, secure and mechanically strong system for attachment of a muzzle device, such as a sound suppressor, muzzle brake, recoil compensator or BFA, to a firearm, and for quickly removing such a device from the firearm.

The preferred embodiment provides a mounting apparatus for attachment to a firearm including a barrel fitted with a flash suppressor. The apparatus has a bore for coaxially receiving the flash suppressor and barrel. The apparatus has a locking collar coaxially positioned on the apparatus and attached to the apparatus via an external threaded section on the apparatus and a matching internal threaded section in the locking collar.

The locking collar has an internal annular groove that is positioned in a plane perpendicular to the longitudinal axis of the bore and near the rear face of the locking collar, with the diameter of the annular groove being less than the external diameter of the locking collar. The rear face of the locking collar has a transverse cut at the top of the rear face, the transverse cut having a depth that aligns with the front surface of the annular groove. The rear face of the locking collar has a cut-out that is perpendicular to the longitudinal axis of the bore and has the same width as the bore. The cut-out extends from the bore to the transverse cut on the rear face of the locking collar and has a depth that aligns with the front surface of the annular groove and thereby opening the top of the annular groove on the rear face of the body.

The locking collar is provided with a u-shaped locking gate having two arms and having two wings extending proud of the locking gate (i.e. protruding beyond the locking gate, so that they are not flush with the surface) at the top of the arms. The u-shaped locking gate is positioned within the internal annular groove and is movable within a plane perpendicular to the longitudinal axis of the bore. The u-shaped locking gate arms each half a longitudinal recess on the outer surface of the gate arms. Two locking pins are positioned near the top of the transverse cut, securing the unshaped locking gate within the annular groove and to the locking collar via the two longitudinal recesses on the u-shaped locking gate arms.

The u-shaped locking gate has a shallow circular recess on the front face of the locking gate. The diameter of the recess is slightly larger than the diameter of the flash suppressor attached to the barrel of the firearm.

The preferred embodiment of the invention provides a muzzle device apparatus for attachment to a firearm that includes a barrel fitted with a flash suppressor, comprising a combination of a muzzle device having a bore for coaxially receiving the flash suppressor, the muzzle device having an attachment section having a external threaded section, and a locking collar having a matching internal threaded section, the locking collar having an internal annular groove that is positioned in a plane perpendicular to the longitudinal axis of the bore and near the rear face of the locking collar with the diameter of the annular groove being less than the external diameter of the locking collar, the rear face of the locking collar having a transverse cut at the top of the rear face, the transverse cut having a depth that aligns with the front surface of the annular groove, and the rear face of the locking collar having a cut-out that is perpendicular to the longitudinal axis of the bore and having the same width as the bore, the cut-out extending from the bore to the transverse cut on the rear face of the locking collar and having a depth that aligns with the front surface of the annular groove and thereby opening the top of the annular groove on the rear face of the body, the locking collar being provided with a u-shaped locking gate having two arms and having two wings extending proud of the locking gate at the top of the arms, the u-shaped locking gate being positioned within the internal annular groove and movable within a plane perpendicular to the longitudinal axis of the bore, the u-shaped locking gate arms each having a longitudinal recess on the outer surface of the gate arms, two locking pins that are positioned near the top of the transverse cut securing the u-shaped locking gate within the annular groove and to the locking collar via the two longitudinal recesses on the u-shaped locking gate arms, and the u-shaped locking gate having a shallow circular recess on the front face of the locking gate, the diameter of the recess being slightly larger than the diameter of the flash suppressor attached to the barrel of the firearm.

The locking collar in combination with the u-shaped locking gate secures the mounting system and attached muzzle device to the rear of the flash suppressor. With the locking gate in the proud position (extending up from the locking collar), the locking gate is then lowered into the annular groove where the circular recess on the front face of the locking gate fits over the rear surface of the flash suppressor. Upon clock-wise rotation of the muzzle device, the muzzle device is secured to the firearm and flash suppressor by tightening it up against the front and rear surfaces of the flash suppressor.

Removal of the mounting system and attached muzzle device is performed by rotating the attached muzzle device counter-clockwise until the locking gate may be lifted up proud of the locking collar, and then the muzzle device is simply pulled forward and off of the flash suppressor.

In an alternative embodiment, a mounting apparatus for attachment to a firearm is provided, including a barrel having an annular flange on the forward portion of the barrel, comprising the combination of a mounting apparatus having a bore for coaxially receiving the barrel, the apparatus having a body coaxially positioned on the apparatus with an external threaded section and an internal threaded section both positioned on the front end of the apparatus; the body having an internal annular groove that is positioned in a plane perpendicular to the longitudinal axis of the bore and near the rear face of the body and having a diameter less than the diameter of the body, the rear face of the body having a cut-out that is perpendicular to the longitudinal axis of the bore and having the same width as the bore, the cut-out extending from the bore to the outer diameter of the body and having a depth that aligns with the front surface of the annular groove and thereby opening the top of the annular groove on the rear face of the body, the mounting apparatus being provided with a u-shaped locking gate having two arms and having two wings extending proud of the locking gate at the top of the arms locking gate, the u-shaped locking gate being positioned within the internal annular groove and movable within a plane perpendicular to the longitudinal axis of the bore, the u-shaped locking gate arms each having a longitudinal recess on the outer surface of the gate arms, two locking pins that are positioned near the top of the transverse cut securing the u-shaped locking gate within the annular groove and to the body via the two longitudinal recesses on the u-shaped locking gate arms, and the u-shaped locking gate having a shallow circular recess on the front face of the locking gate, the diameter of the recess being slightly larger than the diameter of the barrel at the rear of the annular flange on the forward portion of the barrel of the firearm.

The second preferred embodiment of the invention provides a muzzle device apparatus for attachment to a firearm that includes a barrel having an annular flange, comprising a combination of a muzzle device having a bore for coaxially receiving the barrel, the apparatus having a body coaxially positioned on the apparatus with a external threaded section and a internal threaded section both positioned on the front end of the apparatus; the body having an internal annular groove that is positioned in a plane perpendicular to the longitudinal axis of the bore and near the rear face of the body and having a diameter less than the diameter of the body, the rear face of the body having a cut-out that is perpendicular to the longitudinal axis of the bore and having the same width as the bore, the cut-out extending from the bore to the outer diameter of the body and having a depth that aligns with the front surface of the annular groove and thereby opening the top of the annular groove on the rear face of the body, the mounting apparatus being provided with a u-shaped locking gate having two arms and having two wings, the two wings extending proud of the locking gate at the top of the arms, the u-shaped locking gate being positioned within the internal annular groove and movable within a transverse plane perpendicular to the longitudinal axis of the bore, the u-shaped locking gate arms each having a longitudinal recess on the outer surface of the gate arms, two locking pins that are positioned near the outer diameter of the body and in the top half section of the body securing the u-shaped locking gate within the annular groove and to the body via the two longitudinal recesses on the u-shaped locking gate arms, and the u-shaped locking gate having a shallow circular recess on the front face of the locking gate, the diameter of the recess being slightly larger than the diameter of the barrel at the rear of the annular flange on the forward portion of the barrel of the firearm, the body having a concentric opening with an internal threaded section at the front of the body, with a piston having a head with a reduced diameter body and an internal concentric bore, with a compression spring being coaxially positioned on the reduced diameter body of the piston, and an encapsulator having a external threaded section and an internal concentric bore, the encapsulator being attached to the body through threads and retaining the piston and compression spring within the body.

The body in combination with the u-shaped locking gate secures the mounting system and attached muzzle device to the rear surface of the annular flange on the barrel, and with the locking gate in the proud position extending up from the body, the body is then slid over the barrel and rearward against the annular flange on the barrel. Rearward axial longitudinal force is then applied to the body, pushing the piston forward against the compression spring and encapsulator, and at the same time allowing the body to move slightly rearward from the annular flange and positioning the internal annular groove and locking gate rearward of the annular flange. The locking gate is then lowered into the internal annular groove and the rearward axial force is then released, forcing the piston to travel rearward and butt up against the combination of the annular flange and locking gate, maintaining a constant rearward axial pressure on the locking gate and annular flange, and thus securing the body to the annular ridge on the barrel.

Removal of the mounting system and attached muzzle device is performed by providing a rearward axial longitudinal force until the locking gate is able to be lifted up proud of the body and barrel, releasing the rearward axial force and then the muzzle device is simply pulled forward and off of the barrel.

In the context of the specification, the terms "rear" and "rearward" and "front" and "forward" have the following definitions:—"rear" or "rearward" means in the direction towards the muzzle of the firearm while "front" or "forward" means it is in the direction away from the muzzle of the firearm; "longitudinal" means in the direction of or in parallel with the longitudinal axis of the barrel while "transverse" means in a direction across the longitudinal direction.

A muzzle device such as a flash suppressor is attached to the barrel of a firearm, having a cylindrical bore that aligns with the bore of the barrel of a firearm. A muzzle device, preferably a sound suppressor, is positioned over the flash suppressor in a concentric and axial alignment with the flash suppressor and the barrel of the firearm. The sound suppressor has a preferably round body with sound suppression structures that are well known in the art. At the front of the sound suppressor is a front end cap with an opening concentric to the bore of the firearm, while at the rear of the sound suppressor, a mounting system for attachment of the sound suppressor to the firearm is provided.

The mounting system may be secured to the sound suppressor by well-known means such as threading. While the embodiments described herein describe the use of threads for attachment to the sound suppressor, the use of threads is not exclusive and other methods of attachment such as welding or chemical adhesives may be used if so desired, or a combination of these methods may be used.

A rear end body having a shoulder and a short threaded section for attachment to the sound suppressor with a reduced diameter concentric rearward protrusion has a longitudinal bore for reception of the flash suppressor and an outer threaded section. The longitudinal bore has an internal locking flange that is provided with an opening concentric with the bore of the firearm, and the position of the internal locking flange may be varied, depending upon the length of the flash suppressor. The internal locking flange protrudes into the longitudinal bore, thereby restricting the rearward movement of the mounting system when the mount is slid over the flash suppressor. The longitudinal bore is of sufficient diameter to permit body to fit over the flash suppressor.

A cylindrical locking collar having an internal threaded section at the front of the collar has a concentric bore to enable the locking collar to fit onto the rearward protrusion of the body, and at the rear end of the locking collar, the locking collar is provided with an annular inwardly extending flange that in turn has a concentric bore opening allowing the collar to fit over the flash suppressor. The annular inwardly extending flange of the locking collar has an internal annular groove that is positioned in a plane perpendicular to the longitudinal axis of the bore with the diameter of the annular groove being less than the external diameter of the locking collar. This internal annular groove is positioned slightly forward of the rear face of the locking collar. The annular inwardly extending flange has a transverse cut that has a depth that aligns with the front surface of the annular groove. The rear face of the locking collar has a cut out that is perpendicular to the longitudinal axis of the bore and has the same width as the bore, this cut out extending from the bore to the transverse cut on the rear face of the locking collar. This cut out has a depth that extends inward to and aligns with the front surface of the annular groove. Jointly, the transverse cut to the rear face on the top section of the rear face and the cut out on the rear face that is perpendicular to the longitudinal axis of the bore combine together to expose or open the top of the annular groove in the annular inwardly extending flange. This in turn results in the rear face of the locking collar having two walls and two surfaces, the rear outer wall and surface having the cut that is perpendicular to the longitudinal axis of the bore, and the rear inner wall and surface that is formed by the transverse cut that extends inward to the front surface of the inner annular groove.

The rear face of the locking collar is provided with two small holes that protrude inwards through the rear outer wall and into the rear inner wall of the annular inwardly extending flange. These two small lock pinholes are positioned at the top of the rear outer wall and are for two small locking pins that lock the locking collar and the u-shaped locking gate together.

A u-shaped locking gate has two arms with a circular bore that is cutaway at the bottom of the locking gate and at the top of the locking collar, there are two wings, one at the top of each arm, and these wings extend proud of the locking gate. These wings allow for easy grasping of the locking gate during the locking and unlocking of the mount. The circular bore allows the gate to fit over and up against the rear face of the flash suppressor when the gate is in the locked position. On the front face of the locking gate, there is a circular recess that allows the locking gate to interface with the rear of the flash hider upon locking of the mount. This recess is slightly larger than the outside diameter of the flash suppressor and coupled with the radius of the bore in the locking gate, provides an annular shoulder recess that in turn when the mount is locked, bears against the rear face of the flash suppressor. On the outer surfaces of the two arms, there are two recesses or notches that, upon assembly of the locking gate to the locking collar, interface with the two small locking pins that lock the gate and collar together. Near the bottom of the arms and on the inside surface of the arms at the bottom of the circular bore and recess, there are two small flat surfaces or flat lips.

The locking collar is assembled by placing the locking gate into the exposed top of the annular groove in the locking collar, and once the gate is lowered into the annular groove, the two locking pins are then installed into the two small lock pinholes, ensuring that the pins are in fully seated. This ensures that the locking gate is able to be moved up and down in a vertical plane perpendicular to the longitudinal axis of the barrel and the locking collar, but at the same time be unable to be fully removed from the annular groove. The locking collar is then attached to the rear end body by simply screwing it onto the threaded section on the rearward protrusion.

When attaching the sound suppressor onto the flash suppressor and firearm barrel, the locking collar is unscrewed and the locking gate is lifted in a vertical plane by the two wings at the top of the locking gate so that the locking gate protrudes vertically as far as possible. This ensures that the sound suppressor can be placed on the flash suppressor and then moved rearwards without impediment from the locking gate until the internal locking flange stops the rearward movement.

The sound suppressor is placed on the flash suppressor in a rearward movement and the flash suppressor is received by the bore of the locking collar and also the bore of the reduced diameter concentric rearward protrusion that is part of the rear end body. The rearward longitudinal movement continues until the suppressor is unable to be moved any further rearward due to the rear face of the internal locking flange coming into contact with the front face of the flash suppressor.

At this stage, the locking gate is then fully lowered into the annular groove until it is no longer proud. The circular recess on the front face of the locking gate then fits over the rear face of the flash suppressor. The sound suppressor is then rotated in a clock-wise direction, and the sound suppressor is then tightened up against the rear face via the front face and circular recess of the locking gate and against the front face of the flash suppressor via the rear face of the internal locking flange. Once the attachment has been completed, the sound suppressor is secured to the flash suppressor and firearm barrel in both longitudinal and rotational axes.

To remove the suppressor from the flash suppressor and firearm barrel, the sound suppressor is first rotated in a counter-clockwise direction, loosening the rear end body from the locking collar. Once the sound suppressor has been rotated sufficiently to relieve the tension against the front face of the flash suppressor, one grasps the two wings and lifts the locking gate until it can no longer be lifted anymore. The sound suppressor is then withdrawn from the flash suppressor in a forward longitudinal motion until it is removed completely from the flash suppressor and firearm barrel.

A feature of the mounting system thus disclosed is that it is able to be used with a variety of 5.56 mm military rifles fitted with NATO standard flash suppressors that are varying in length but have a outside diameter of 22 millimeters. As an example, the length of the flash suppressor for the M4/M16 rifles is shorter than the length of the flash suppressor for the Heckler & Koch 5.56 mm rifle, yet both are the same outside diameter. The lengths of the internal threaded section on the locking gate and the external threaded section on the reduced diameter rearward protrusion that is part of the rear end body as well as the position of the internal locking flange within the longitudinal bore of the rear end body are the factors that determine the corresponding maximum length flash suppressor that the mounting system is able to be attached. Conversely, if it is required that the mounting system is to be attached only to flash suppressors of a certain length, then the corresponding lengths of the threaded sections may be shortened so that they allow attachment to flash suppressors up to the specific length only. If the mounting system was intended only for attachment to flash suppressors for the M4/M16 series of rifles, then the corresponding lengths of thread would be such that they allowed for the attachment and detachment to this length flash suppressor with a certain number of turns of the sound suppressor being required. It should be noted that, while the thread pitch may be of a fine pitch, this is not exclusive and other types of threads may be used, such as the ACME-type threads where only a small number of turns is required to fully lock the suppressor onto the flash suppressor.

Alternative Embodiment

The second preferred embodiment discloses a mounting apparatus for attachment to a firearm where the barrel of the firearm has a barrel having an annular flange on the forward portion of the barrel. A muzzle device, preferably a sound suppressor, is positioned on the barrel in a concentric and axial alignment with the barrel of the firearm. The sound suppressor has a preferably round body with sound suppression structures that are well known in the art. At the front of the sound suppressor is a front end cap with an opening concentric to the bore of the firearm, while at the rear of the sound suppressor, a mounting system for attachment of the sound suppressor to the firearm is provided.

The mounting system may be secured to the sound suppressor by well-known means such as threading. While the embodiments described herein describe the use of threads for attachment to the sound suppressor, the use of threads is not exclusive and other methods of attachment such as welding or chemical adhesives may be used if so desired, or a combination of these methods may be used.

A rear end body having a shoulder and a short external threaded section for attachment to the sound suppressor has a longitudinal bore for coaxially receiving the barrel, with the external threaded section and an internal threaded section both being positioned on the front end of the body. The longitudinal bore is of sufficient diameter to permit the body to fit over the barrel of the firearm.

At the rear end of the body, the body is provided with a concentric bore opening allowing the body to fit over the barrel of the firearm. The body has an internal annular groove that is positioned in a plane perpendicular to the longitudinal axis of the bore and has a diameter less than the diameter of the body. This internal annular groove is positioned slightly forward of the rear face of the body. The rear face of the body has a cut-out that is perpendicular to the longitudinal axis of the bore and having the same width as the bore, the cut-out extending from the bore to the outer diameter of the body and having a depth that aligns with the front surface of the annular groove and thereby opening the top of the annular groove on the rear face of the body. The rear face of the body has a cut out that is perpendicular to the longitudinal axis of the bore and has the same width as the bore, and the cut out extends from the bore to the outer diameter of the body. This cut out has a depth that extends inward to and aligns with the front surface of the annular groove, and opens the top of the annular groove in the annular inwardly extending flange. This in turn results in the rear face of the locking collar having two walls and two surfaces, the rear outer wall and surface having the cut that is perpendicular to the longitudinal axis of the bore, and the rear inner wall and surface that is formed by the cut perpendicular to the longitudinal axis of the bore that extends inward to the front surface of the inner annular groove.

The rear face of the body is provided with two small holes that protrude inwards through the rear outer wall and into the rear inner wall of the body. These two small lock pinholes are positioned so that they are in alignment with the outside diameter of the inner annular groove the rear outer wall and are for two small locking pins that lock the body and the u-shaped locking gate together.

A U-shaped locking gate has two arms with a circular bore that is cutaway at the bottom of the locking gate and at the top of the locking collar, there are two wings, one at the top of each arm, and these wings extend proud of the locking gate. These wings allow for easy grasping of the locking gate during the locking and unlocking of the mount. The circular bore allows the gate to fit over and up against the rear face of the annular barrel flange when the gate is in the locked position. On the front face of the locking gate, there is a circular recess that allows the locking gate to interface with the rear of the annular barrel flange upon locking of the mount. This recess is slightly larger than the outside diameter of the annular barrel flange and coupled with the radius of the bore in the locking gate, provides an annular shoulder recess that in turn when the mount is locked, bears against the rear face of the annular barrel flange. On the outer surfaces of the two arms, there are two recesses or notches that, upon assembly of the locking gate to the locking collar, interface with the two small locking pins that lock the gate and collar together. Near the bottom of the arms and on the inside surface of the arms at the bottom of the circular bore and recess, there are two small flat surfaces or flat lips.

A piston having a head with a reduced diameter body and an internal concentric bore, is provided with the diameter of the piston head being slightly less than the longitudinal bore of the body. A compression spring, having an external diameter slightly less than the bore diameter of the body and an internal diameter slightly greater than the external diameter of the piston body is positioned on the piston body. At the front of the body, an encapsulator having an external threaded section and an internal concentric bore, is attached to the body through threads. and retaining the piston and compression spring within the body.

The mounting system is assembled by placing the locking gate into the exposed top of the annular groove in the body, and once the gate is lowered into the annular groove, the two locking pins are then installed into the two small lock pinholes, ensuring that the pins are in fully seated. This ensures that the locking gate is able to be moved up and down in a vertical plane perpendicular to the longitudinal axis of the barrel and the body, but at the same time be unable to be fully removed from the annular groove. The piston and compression spring are then placed inside the body and the encapsulator is then screwed into the body, thus compressing the spring slightly. The body is then attached to the rear end of the sound suppressor by simply screwing it into the threaded section of the sound suppressor.

When attaching the sound suppressor onto the firearm barrel, the locking gate is lifted in a vertical plane by the two wings at the top of the locking gate so that the locking gate protrudes vertically as far as possible. This ensures that the sound suppressor can be placed on the flash suppressor and then moved rearwards without impediment from the locking gate until the annular barrel flange stops the rearward movement.

The sound suppressor is placed on the barrel in a longitudinal rearward movement and the bore of the body receives the barrel. The rearward longitudinal movement continues until the suppressor comes into contact with the front face of the annular barrel flange.

Rearward axial longitudinal force is then applied to the suppressor, and this in turn results in the piston being pushed forward against the compression spring and encapsulator.

At this stage, the locking gate is then fully lowered into the annular groove until it is no longer proud. The circular recess on the front face of the locking gate then fits over the rear face of the annular barrel flange. The rearward axial longitudinal force is then released, forcing the piston to travel rearward and butt up against the combination of the annular barrel flange and locking gate, maintaining a constant rearward axial pressure on the locking gate and annular flange, and thus securing the body to the annular ridge on the barrel. Once the attachment has been completed, the sound suppressor is secured to the firearm barrel in both longitudinal and rotational axes.

To remove the suppressor from the firearm barrel, the sound suppressor is first pushed in a rearward longitudinal direction, resulting in the piston being pushed forward against the compression spring and encapsulator, thereby relieving the constant rearward axial pressure on the locking gate and annular barrel flange. Once this pressure has relieved, one grasps the two wings and lifts the locking gate until it can no longer be lifted anymore. The sound suppressor is then withdrawn from the barrel in a forward longitudinal motion until it is removed completely from the firearm barrel.

The mounting system thus described provides for a quick and easy, yet reliable and mechanically strong attachment system for muzzle devices, such as sound suppressors, to be attached to the barrel of a firearm that has an annular barrel flange positioned on the forward portion of the firearm barrel.

It should be understood that, while a sound suppressor is described as the preferred muzzle device that is attached to the mounting system disclosed herein, other muzzle devices such as muzzle brakes, recoil compensators and BFAs (Blank Firing Adapters) may also use the mounting system for attachment to a flash suppressor or a barrel of a firearm that has an annular barrel flange positioned on the forward portion of the firearm barrel.

While the above is discussed in terms of preferred and alternative embodiments, the invention is not intended to be so limited.

The invention claimed is:

1. A facility for connection to a firearm with a muzzle extending to define a forward direction, the muzzle having an enlarged end portion having a first diameter larger than a second diameter corresponding to a barrel portion adjacent to the enlarged end portion, the facility comprising:

a body having an axis;

the body having a bore centered on the axis;

the body having a gate passage;

a gate element received in the gate passage for movement along a gate path perpendicular to the axis;

the gate element being operable for movement between a closed position preventing extraction of the end portion from the bore and an open position enabling extraction of the end portion from the bore;

the gate element being a planar body having a first face and an opposed second face;

the gate element having spaced apart arms with free ends defining a gap therebetween;

the gap having a width smaller than the first diameter and larger than the second diameter, such that the barrel portion may pass through the gap, and at least a portion of the enlarged end portion may not pass through the gap;

the first face defining a recessed area sized to receive a rear portion of the enlarged end portion of the muzzle when the gate element is in the closed position;

the recessed area defining a recess plane below the first face, the recessed area being bounded by a shoulder;

the gate element having opposed shoulder portions, each positioned at a free end of the gate element, each protruding above the recess plane, and spaced apart by a distance less than the first diameter, such that the shoulder portions are operable to engage the enlarged end portion to prevent movement of the gate element to the open position, when a rear portion of the enlarged end portion of the muzzle is received in the recessed area.

2. The facility of claim 1 wherein the first face faces the forward direction.

3. The facility of claim 1 wherein the body includes a spring biasing element that biases the body in the forward direction.

4. The facility of claim 1 wherein the body includes an inner sleeve defining a bore, and a spring biasing the inner sleeve in the rearward direction.

5. The facility of claim 4 wherein the inner sleeve includes a stop operable to engage the end portion, such that the body may be biased rearwardly when the muzzle end portion is received in the inner sleeve to enable movement of the gate element to the closed position.

6. The facility of claim 1 wherein the bore of the body closely receives at least a portion of the enlarged end portion of the muzzle.

7. The facility of claim 1 wherein the gate element has a U-shaped profile defining a channel.

8. The facility of claim 7 wherein the channel has a base portion concentric with the axis.

9. The facility of claim 1 wherein the recessed area is defined by an accurate boundary centered on the axis and having a diameter sized to closely receive the rear end portion of the enlarged end portion.

10. The facility of claim 1 wherein the boundary of the recessed area encompasses at least a major portion of the rear portion of the enlarged end portion of the muzzle, when the rear portion is received in the recessed area.

11. The facility of claim 1 wherein the body includes a functional device having a bullet passage, the functional device selected from the group of devices including sound suppressors, flash suppressors, muzzle breaks, adapters, and launching apparatus.

12. A method of removably securing a device to a firearm muzzle having an enlarged end portion with a free end extending in a forward direction, the muzzle having an enlarged end portion having a first diameter larger than a second diameter corresponding to a barrel portion adjacent to the enlarged end portion, comprising the steps:

providing a body having a bore sized to closely receive the end portion;

providing a movable gate received by the body;

the gate being operable for movement between a closed position preventing extraction of the end portion from the bore and an open position enabling extraction of the end portion from the bore;

the gate being a planar body having a first face and an opposed second face;

the gate having spaced apart arms with free ends defining a gap therebetween;

the gap having a width smaller than the first diameter and larger than the second diameter, such that the barrel portion may pass through the gap, and at least a portion of the enlarged end portion may not pass through the gap;

the first face defining a recessed area sized to receive a rear portion of the enlarged end portion of the muzzle when the gate is in the closed position;

the recessed area defining a recess plane below the first face, the recessed area being bounded by a shoulder;

the gate having opposed shoulder portions, each positioned at a free end of the gate element, each protruding above the recess plane, and spaced apart by a distance less than the first diameter;

shifting the gate into the open position;

inserting the end portion into the bore;

moving the body in a rearward direction until the rear portion of the enlarged end portion of the muzzle is positioned in front of the forward face of the movable gate;

shifting the gate into the closed position rearward of the enlarged end portion; and releasing the body to engage the gate to the end portion, such that the gate is secured in the closed position.

13. The method of claim 12 further compromising providing a providing a spring and wherein the step of moving the body in a rearward direction includes moving against a spring biasing force of the spring.

14. The method of claim 12 wherein the body includes a stop, and wherein the step of releasing the body includes compressing the end portion between the stop and the gate.

15. The method of claim 12 wherein the steps of shifting the gate into the open position and shifting the gate into the closed position includes sliding the gate in a direction perpendicular to the rearward direction.

16. The method of claim 15 further comprising providing a providing a spring and wherein the step of moving the body to the rearward position includes applying force against a spring biasing force of the spring.

17. The method of claim 12 including removing the device by the step of moving the body in the rearward direction to a rearward position, and shifting the gate from the closed position to the open position while the body is in the rearward position.

18. A facility for connection to a firearm having an enlarged cylinder at the muzzle of a barrel, the enlarged cylinder having a first diameter larger than a second diameter corresponding to a barrel portion adjacent to the enlarged cylinder, the facility comprising:

a body defining a bore sized to closely receive the cylinder;

the body having a stop associated with the bore to limit the insertion depth of the cylinder;

a gate received by the body for movement along the path perpendicular to an axis defined by the bore;

the gate being operable for movement between a closed position preventing extraction of the cylinder from the bore and an open position enabling extraction of the cylinder from the bore;

the gate being a planar body having a first face and an opposed second face;

the gate element having spaced apart arms with free ends defining a gap therebetween;

the gap having a width smaller than the first diameter and larger than the second diameter, such that the barrel portion may pass through the gap, and at least a portion of the cylinder may not pass through the gap;

the gate defining a recessed area sized to receive a rear portion of the cylinder; and a spring biasing element operable to generate compressive axial force between the gate and the stop, upon the cylinder.

* * * * *